US007246872B2

(12) United States Patent
Park

(10) Patent No.: US 7,246,872 B2
(45) Date of Patent: Jul. 24, 2007

(54) AUTOMATIC MAINTENANCE-PERFORMING APPARATUS AND METHOD THEREOF OF AN IMAGE FORMING DEVICE

(75) Inventor: Bong-wook Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 185 days.

(21) Appl. No.: 10/732,245

(22) Filed: Dec. 11, 2003

(65) Prior Publication Data

US 2004/0165029 A1 Aug. 26, 2004

(30) Foreign Application Priority Data

Feb. 21, 2003 (KR) ..... 10-2003-0011123

(51) Int. Cl.
*B41J 2/165* (2006.01)

(52) U.S. Cl. ..... 347/22; 347/23; 347/29; 347/33

(58) Field of Classification Search ..... 347/22, 347/23, 29, 30.32, 33, 35, 40
See application file for complete search history.

(56) References Cited

U.S. PATENT DOCUMENTS 5,483,266 A * 1/1996 Nakamura ..... 347/23
6,062,670 A * 5/2000 Iwata et al. ..... 347/23
6,070,959 A * 6/2000 Kanbayashi et al. ..... 347/11

FOREIGN PATENT DOCUMENTS

KR 2000-62796 10/2000

OTHER PUBLICATIONS

Korean Office Action for App. No. 10-2003-11123, dated Aug. 24, 2005.
Chinese Office Action issued for App. No. 200410003136 (6 pages including translation).
Chinese Office Action issued for App. No. 200410003136 (6 pages including translation).

* cited by examiner

*Primary Examiner*—Shih-Wen Hsieh
(74) *Attorney, Agent, or Firm*—Staas & Halsey LLP

(57) ABSTRACT

An automatic maintenance-performing method to determine whether a first and a second power supply are operational, and performing a periodic maintenance operation at a predetermined time by supplying an electric power to the second power supply when the first power supply is in an 'on' state and the second power supply is in an 'off' state, and at the predetermined period without supplying the electric power to the second power supply when both the first and second power supplies are in the 'on' state, as a result of the decision. Further, an automatic maintenance-performing apparatus having an automatic maintenance executing unit including a power supplying part having a first power supply to supply an electric power to the control unit and connected to a power plug, and a second power supply to supply the electric power to at least the maintenance unit and connected to the power plug through a power switch, and a maintenance executing part counting time and performing the maintenance operation when the counted time surpasses the predetermined time period. The apparatus and method is provided to an image forming device to prevent ink ejection nozzles from being dried and choked and thereby prevents deterioration of the performance of print heads when the image forming device is on standby or not in use over a period of time, by automatically performing the periodic maintenance operation.

22 Claims, 4 Drawing Sheets

AUTOMATIC MAINTENANCE-PERFORMING APPARATUS AND METHOD THEREOF OF AN IMAGE FORMING DEVICE

CROSS-REFERENCE TO RELATED APPLICATIONS

This application claims the priority of Korean Patent Application No. 2003-11123, filed on Feb. 21, 2003, in the Korean Intellectual Property Office, the disclosure of which is incorporated herein in its entirety by reference.

BACKGROUND OF THE INVENTION

1. Field of the Invention

The present invention relates to an automatic maintenance-performing apparatus and method thereof of an image forming device, for example, an office machine that uses a print head, such as an inkjet printer and a multi-function machine, more particularly, to an automatic maintenance-performing apparatus and method thereof of an image forming device, which performs periodic maintenance operations even when the image forming device is on standby or has not been in use over a long period of time, thereby, preventing ink ejection nozzles of print heads from being dried and choked, thus, preventing deterioration of the performance of the print heads.

2. Description of the Related Art

Generally, an image forming device using a print head, for example, an inkjet printer, comprises a paper feeder, a paper transporter, a printing part, a paper-discharging part, and a maintenance apparatus.

Among these components of the inkjet printer, the maintenance apparatus maintains and preserves ink ejection nozzles of print heads in a normal state, and is essential to ensuring that the print heads perform adequately.

Referring to FIG. 1, there is illustrated a general maintenance apparatus 1 used in an inkjet printer.

The maintenance apparatus 1 comprises: a housing 5 connected to a main frame (not shown) of the inkjet printer, a capping member 10 installed inside the housing 5 that comprises two caps 16 to seal surfaces of ink ejection nozzles 3 of mono and color print heads 2 (one shown only) mounted to a carrier (not shown), a wiping member 20 installed inside the housing 5 that comprises two wipers 24 to wipe the surfaces of the ink ejection nozzles 3 of the print heads 2, a power transmission part (not shown) to receive a rotation force from a bi-directional motor (not shown) provided separately from a carrier motor to drive the carrier with the print head 2 mounted therein, a capping member transporting part 14 and 40 to convert a rotation force of the power transmission part to a vertical force and transmit the converted force to the capping member 10, and a wiping member transporting part 26, 28, and 50 to convert the rotation force of the power transmission part to a horizontal force, and transmit the converted force to the wiping member 20.

The maintenance operation of the maintenance apparatus 1 is carried out by driving the bi-directional motor in one direction, for example, in a clockwise direction to uncap and wipe the surfaces of the ink ejection nozzles 3 of the print heads 2 through the capping member transporting part 14 and 40 and the wiping member transporting part 26, 28, and 50, controlling switching elements connected with heaters of the print heads 2 to spit ink through the ink ejection nozzles 3 of the print heads 2, and driving the bi-directional motor in the other direction, that is, in an anti-clockwise direction to wipe and cap the surfaces of the ink ejection nozzles 3 of the print heads 2 through the wiping member transporting part 26, 28, and 50 and the capping member transporting part 14 and 40.

However, the conventional maintenance apparatus 1 of the inkjet printer does not perform the maintenance operation when a power switch (not shown) is turned off or when the power switch is turned on unless a print command or a head cleaning command is issued, even when a power plug (not shown) of the inkjet printer is connected to a socket (not shown) of an electric power source.

Accordingly, when the inkjet printer has not been used over a long period time, for example, for several months, and the power switch is maintained in an 'off' state over the several months or the power switch is maintained in an 'on' state without performing a print operation or the head cleaning operation, ink remaining on the surface of the ink ejection nozzles 3 of the print heads 2 after the previous print operation dries with the passage of time, and causes a portion or all of the ink ejection nozzles 3 of the print head 2 to choke, even when the print heads 2 are maintained at a capping position of capping the surface of the ink ejection nozzles 3 thereof through the caps 16.

When a portion or all of the ink ejection nozzles 3 are choked as described above, the print head 2 can not jet ink through the chocked portion of the ink ejection nozzles 3, thereby, causing deterioration of a picture quality during a print operation.

SUMMARY OF THE INVENTION

Accordingly, it is an aspect of the present invention to provide an automatic maintenance-performing apparatus and method thereof of an image forming device, which can automatically perform periodic maintenance operations even when the image forming device is on standby or has not been used over a long time, thereby, preventing ink ejection nozzles of print heads from being dried and choked and causing deterioration of the performance of the print heads.

The foregoing and/or other objects and advantages are realized by providing an automatic maintenance-performing method of an image forming device having a maintenance unit to perform a maintenance operation to ink ejection nozzles to jet ink of print heads and a control unit to control the maintenance operation having a timer, comprising an operation of automatically performing the maintenance operation at a predetermined time to prevent the ink ejection nozzles of the print heads from being dried and choked, thereby, deteriorating the performance of the print heads when the image forming device is on standby or has not been used over a long period of time.

Additional aspects and advantages of the invention will be set forth in part in the description which follows and, in part, will be obvious from the description, or may be learned by practice of the invention.

According to an aspect of the present invention, the operation of automatically performing the maintenance operation comprises: determining whether a first and a second power supply are in operation, the first power supply being connected to a power plug to supply an electric power to the control unit, and the second power supply being connected to the power plug through a power switch to supply the electric power to at least the maintenance unit, and operating at least one of the print heads and the maintenance unit at the predetermined time when the first power supply is in an 'on' state and the second power supply is in an 'off' state.

Further, the determination of whether the first and the second power supply are in operation, further comprises: determining the first power supply is operating and in the 'on' state when the power plug is connected to a socket of an electric power source, and determining the second power supply is operating and in the 'on' state by one of when the power switch is turned on and when the control unit generates a control signal by one of a command from an automatic maintenance executing program to control the control unit to perform the maintenance operation when a time counted by the timer coincides with the predetermined period, a command inputted through a control panel connected to the control unit, and a command from an outside computer.

The operation of operating at least one of the print heads and the maintenance unit is carried out by beginning counting time via the timer of the control unit, deciding whether the time counted by the timer coincides with the predetermined time, supplying the electric power to the second power supply when the counted time coincides with the predetermined period, cleaning the print heads by operating the at least one of print heads and the maintenance unit after the electric power is supplied to the second power supply, and disconnecting the electric power from the second power supply after the at least one of the print heads and the maintenance unit has been operated.

The operations of supplying and disconnecting the electric power to and from the second power supply are respectively carried out by turning on and off a switching portion connected to one of the power plug and the first power supply in response to the control signal of the control unit.

The automatic maintenance-performing method further comprises: determining whether at least one of a print command from the outside computer and a print head cleaning command is inputted when both the first and second power supply are determined to be operating and in the 'on' state during the operation of determining whether the first and the second power supplies are in operation, and operating the at least one of the print heads and the maintenance unit to perform the maintenance operation at the predetermined time when the at least one of the print command from the outside computer and the print head cleaning command is determined to be not inputted, and at the predetermined time starting from a point of time when one of a printing operation and a print head cleaning operation is performed according to corresponding command when the at least one of the print command from the outside computer and the print head cleaning command is determined as having been inputted.

At this time, the operation of operating the at least one of the print heads and the maintenance unit upon determining whether the at least one of the print command from the outside computer and the print head cleaning command is input is carried out by beginning counting time via the timer of the control unit, determining whether the time counted by the timer coincides with the predetermined period, and cleaning the print heads by operating the at least one of print heads and the maintenance unit when the counted time coincides with the predetermined period.

According to another aspect of the present invention, an automatic maintenance-performing apparatus of an image forming device is provided. The automatic maintenance-performing apparatus of an image forming device comprises: a maintenance unit to perform a maintenance operation to ink ejection nozzles to jet ink of print heads, a control unit to control the maintenance operation, and an automatic maintenance executing unit to automatically perform the maintenance operation at a predetermined time to prevent the ink ejection nozzles of the print heads from being dried and choked, and thereby deteriorate the performance of the print heads when the image forming device is on standby or not used for a long period of time.

According to an aspect of the invention, the automatic maintenance executing unit is provided with a power supplying part having a first power supply to supply an electric power to the control unit and connected to a power plug, and a second power supply to supply the electric power to at least the maintenance unit and connected to the power plug through a power switch; and a maintenance executing part to start count of time and to supply the electric power to the second power supply to perform the maintenance operation depending on whether the second power supply is in an 'on' state or an 'off' state when the counted time passes a predetermined time period.

According to an aspect of the invention, the maintenance executing part further comprises a switching portion connected to one of the power plug and the first power supply, a timer built in the control unit to count time, and an automatic maintenance executing program included in the control unit and operating the switching portion to supply the electric power to the second power supply and thereby perform the maintenance operation, depending on whether the second power supply is in the 'on' state or the 'off' state when the counted time coincides with the predetermined time period.

BRIEF DESCRIPTION OF THE DRAWINGS

The above and/or other aspects and advantages of the invention will become apparent, and more readily appreciated from the following description of the preferred embodiments taken in conjunction with accompanying drawings, of which.

DETAILED DESCRIPTION OF THE PREFERRED EMBODIMENTS

Figure 1:
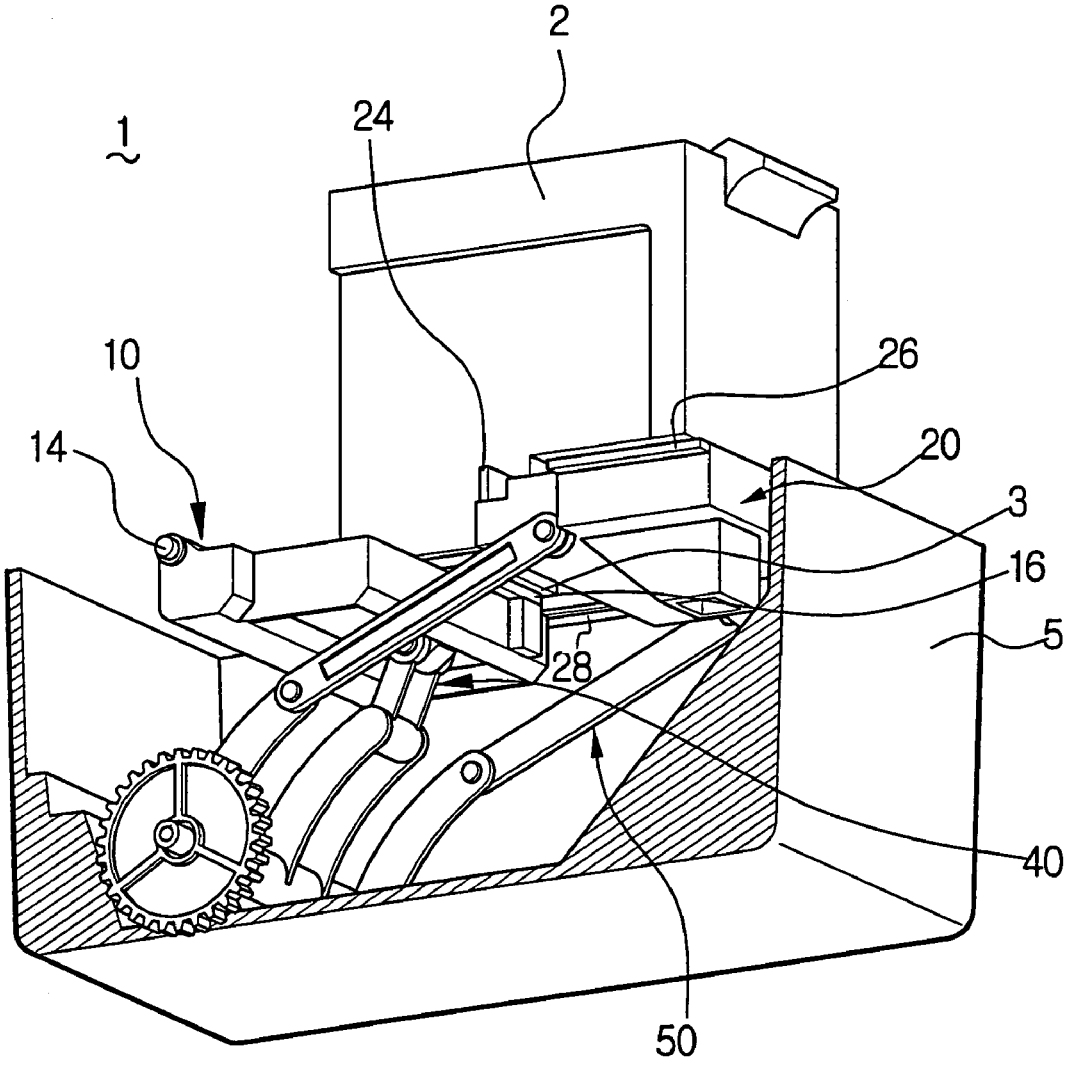
FIG. 1 (PRIOR ART)
FIG. 1 is a partial perspective view of a conventional maintenance apparatus of an inkjet printer.

Reference will now be made in detail to the embodiments of the present invention, examples of which are illustrated in the accompanying drawings, wherein like reference numerals refer to the like elements throughout.

Figure 2:
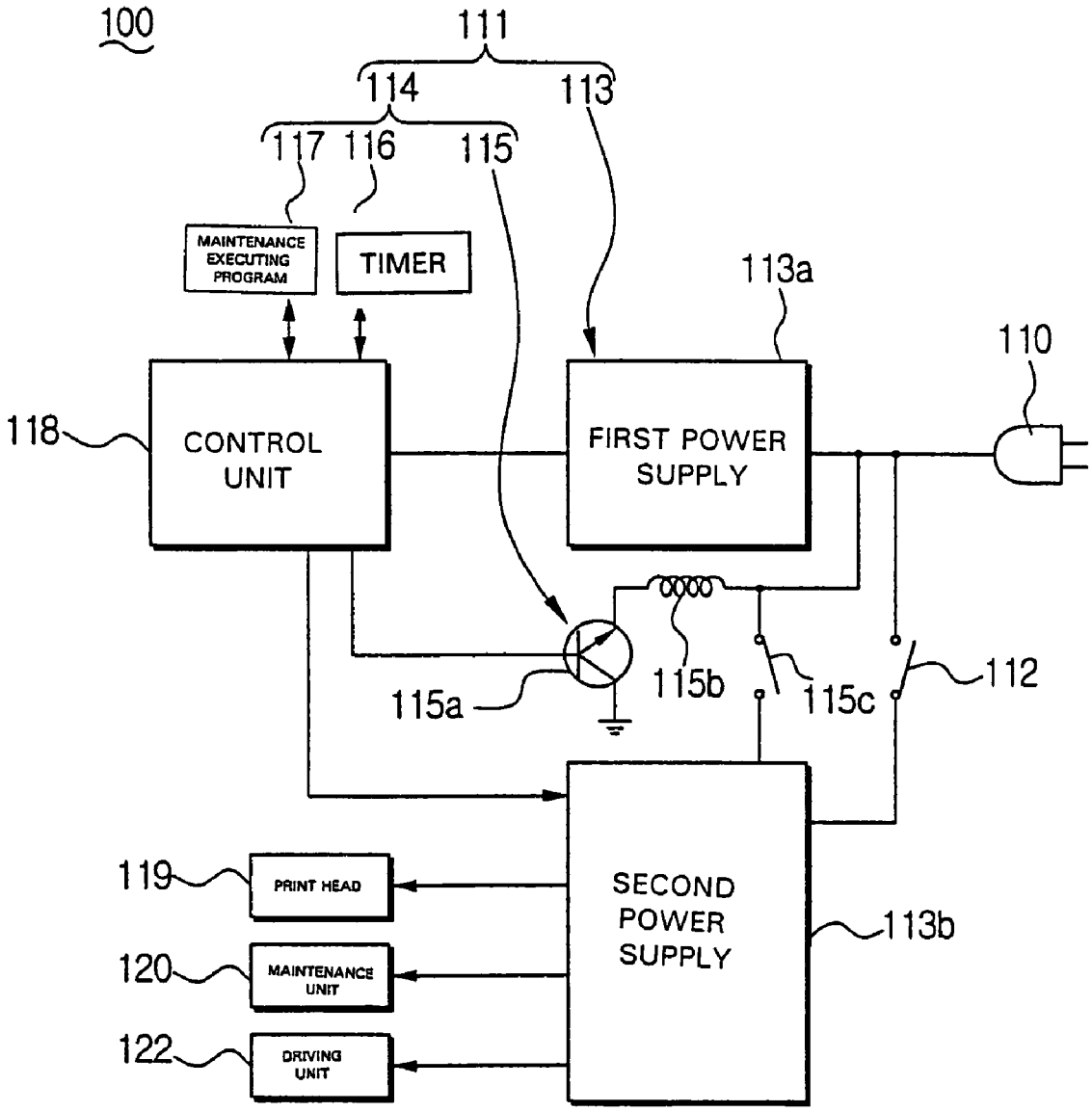
FIG. 2 is a schematic block diagram of an ink jet printer to which an automatic maintenance-performing apparatus according to an aspect of the present invention is provided.

FIG. 2 shows an inkjet printer 100 to which an automatic maintenance-performing apparatus 111 according to an aspect of the present invention is provided. The inkjet printer 100 comprises: a maintenance unit 120 to perform a maintenance operation to ink ejection nozzles (not shown) to jet ink of mono and color print heads 119 (one shown), a driving unit 122 to drive a pickup roller (not shown), a feed roller (not shown), and a carrier (not shown) having the print heads 119 mounted therein, a control unit 118 to control the maintenance unit 120 and the driving unit 122, and an automatic maintenance-performing apparatus 111 according to an aspect of the present invention to automatically perform the maintenance operation at a predetermined time to prevent the ink ejection nozzles of the print heads 119 from being dried and choked and deteriorating performance of the print heads 119 when the printer 100 is on standby or has not been used for a long time.

The maintenance unit 120 is provided with a housing (not shown) connected to a main frame (not shown) in the inkjet printer 100, a capping member (not shown) installed in the housing and comprising two caps to seal the surfaces of the ink ejection nozzles of the mono and color print heads 119 mounted to the carrier and movable between a printing position and a maintenance position, a wiping member (not shown) installed in the housing and comprising two wipers to wipe the surfaces of the ink ejection nozzles of the print heads 119, a power transmission part (not shown) to receive a rotation force from a maintenance driving motor (not shown) provided separately from a carrier driving motor (not shown) to drive the carrier, a capping member transporting part (not shown) to convert a rotation force of the power transmission part to a vertical force and transmit the converted force to the capping member, and a wiping member transporting part (not shown) to convert a rotation force of the power transmission part to a horizontal force and transmit the converted force to the wiping member and having a used ink storing portion to store used ink jetted from the ink ejection nozzles of the print heads 119 in a spiting operation.

Description of the construction of the component parts of the maintenance unit 120 will be omitted here, as it is similar to that of the conventional ones that are described above with reference to FIG. 1.

The maintenance driving motor which is connected to a second power supply 113*b* of a power supplying part 113, is controlled by the control unit 118, thereby operating the maintenance unit 120 to perform the maintenance operation of uncapping, wiping, and capping the surface of the ink ejection nozzles of the print heads 119.

Alternatively, the maintenance unit 120 can be substituted by any other known maintenance unit (not shown), which is operated by a moving force of the carrier instead of using the separate maintenance driving motor.

For example, the maintenance unit can comprise a housing (not shown) having an inclined guide slot therein, and a moving body having a wiping and a capping member wiping and capping the surfaces of the ink ejection nozzles of the print heads 119, respectively, and a guide projection moving up and down along the inclined guide slot of the housing by the moving force of the carrier, and thereby allow the wiping and the capping members to wipe and cap the surfaces of the ink ejection nozzles of the print heads 119, respectively. Accordingly, during the maintenance operation, the carrier is moved from a capping position to a head cleaning position by the carrier driving motor of the driving unit 122 to allow the moving body to uncap and wipe the surface of the ink ejection nozzles of the print heads 119 via the wiping and the capping members, and at the head cleaning position, the print heads 119 are controlled to spit ink through the ink ejection nozzles by a control signal of the control unit 118.

The driving unit 122 is provided with a carrier driving motor to drive the carrier having the print heads 119 mounted therein as described above, and a paper feed driving motor (not shown) to drive the pickup roller and the feed roller.

The control unit 118 controls the operation of switching elements (not shown) such as transistors connected to heaters (not shown) of the print heads 119 to jet ink through the ink ejection nozzles of the print heads 119, as well as the operations of the maintenance unit 120 and the driving unit 122.

The automatic maintenance-performing apparatus 111 according to an aspect of the present invention is provided with an automatic maintenance-executing unit comprising: a power supplying part 113 having a first power supply 113*a* connected to a power plug 110, and a second power supply 113*b* connected to the power plug 110 through a power switch 112; and a maintenance executing part 114 to count time and supply the electric power to the second power supply 113*b* to perform the maintenance operation depending on whether the second power supply 113*b* is in an 'on' state or an 'off' state when the counted time passes a predetermined time period, for example, one month.

The first power supply 113*a* of the power supplying part 113 converts an electric power supplied from the power plug 110 to a voltage required by the control unit 118 to supply thereto, where the second power supply 113*b* converts the electric power supplied from the power plug 110 to a voltage required by the maintenance driving motor of the maintenance unit 120, the paper feed driving motor and the carrier driving motor of the driving unit 122, and the switching elements of the print heads 119 to supply hereto.

Accordingly, when the power plug 110 is connected to a socket (not shown) of an electric power source, the electric power is supplied only to the control unit 118 through the first power supply 113*a* to minimize consumption of the electric power when the power switch 112 is turned off, but the electric power is supplied to the control unit 118, the print heads 119, the maintenance unit 120, and the driving unit 122 to perform a normal printing operation when the power switch 112 is turned on.

The maintenance executing part 114 comprises: a switching portion 115 connected to the power plug 110, a timer 116 built in the control unit 118 to count the time, and an automatic maintenance executing program 117 provided to the control unit 118 and operating the switching portion 115 to supply the electric power to the second power supply 113*b* and thereby perform the maintenance operation, depending on whether the second power supply is in the 'on' state or the 'off' state when the time counted by the timer 116 coincides with the predetermined time period.

The switching portion 115 is comprises a transistor 115*a* to operate in response to the control signal of the control unit 118, an inductance 115*b* to receive the electric power from the power plug 110 in accordance with to the operation of the transistor 115*a*, and a relay switch 115*c* switchable by a magnetic induction phenomenon generating when the inductance 115*b* receives the electric power from the power plug 110.

The switching portion 115 functions to connect or disconnect the second power supply 113*b* to or from the power plug 110, connected to the socket of the electric power source, in accordance with a reserved print command inputted into the control unit 118 from an outside computer or a reserved print command inputted into the control unit 118 through a control panel (not shown) connected thereto, and a maintenance command of the control unit 118 issued by the automatic maintenance executing program 117.

Figure 3:
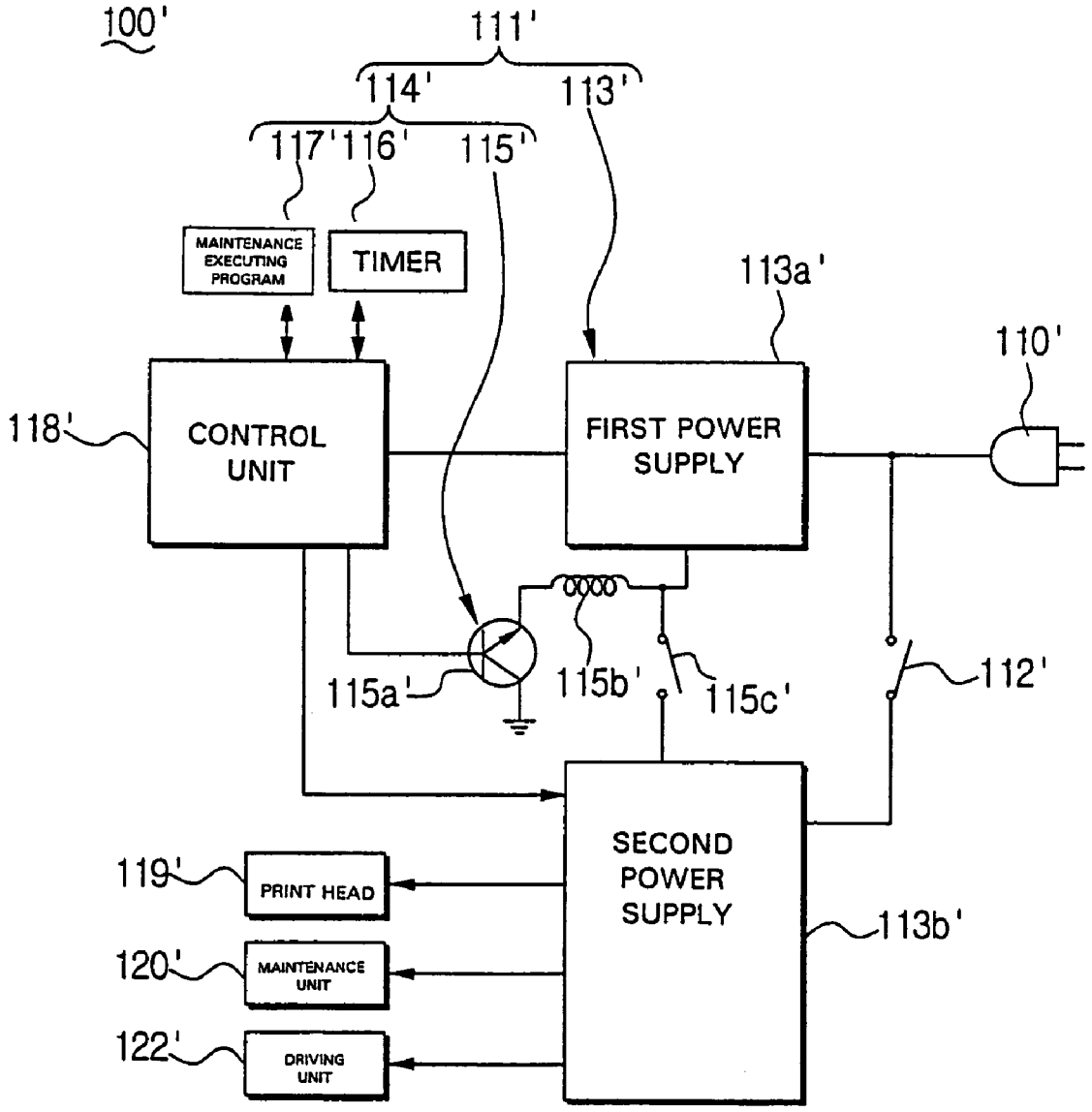
FIG. 3 is a schematic block diagram of an ink jet printer to which an automatic maintenance-performing apparatus according to another aspect of the present invention is provided.

It should be noted that even though the switching portion 115 is illustrated and explained as disposed between the power plug 110 and the second power supply 113*b*, according to an inkjet printer 100' shown in FIG. 3 to which an automatic maintenance-performing apparatus 111' according to an aspect of the invention is provided, it may also be disposed between a first power supply 113*a*' and a second power supply 113*b*'. In this case, the second power supply 113*b*' has a voltage converter that can convert a voltage of the first power supply 113*a*' to a voltage required by a maintenance driving motor of a maintenance unit 120', a paper feed motor and a carrier driving motor of the driving unit 122', and switching elements of print heads 119'.

The automatic maintenance executing program 117 of the control unit 118 is provided to perform the maintenance operation, without supplying the electric power to the second power supply 113*b*, by immediately turning on the switching portion 115 if the second power supply 113*b* is already maintained in the 'on' state by the power switch 112 at a point of time when the time counted by the timer 116 passes the predetermined time period.

Figure 4:
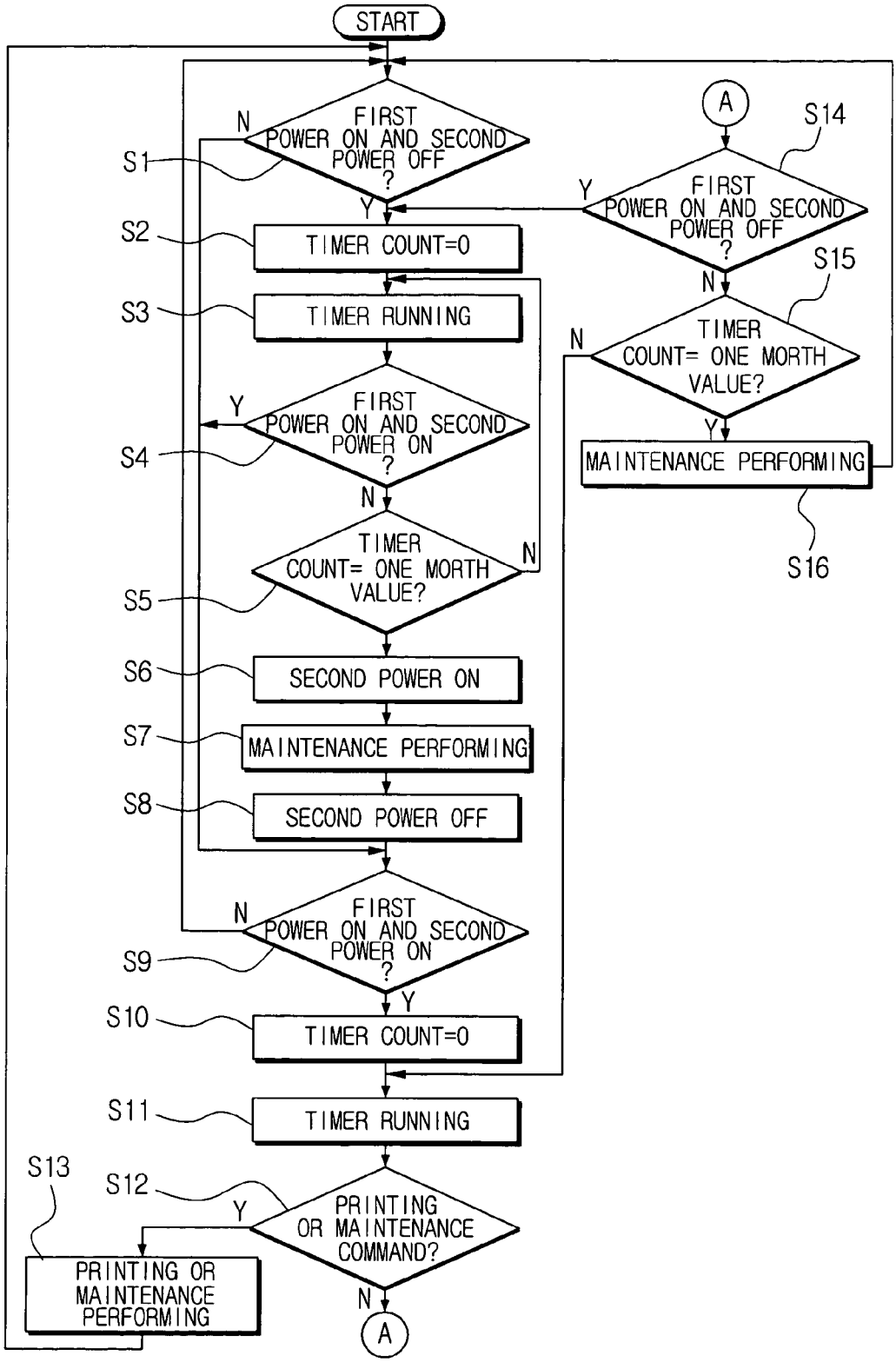
FIG. 4 is a flow chart to show the operation of the automatic maintenance-performing apparatus of the inkjet printer.

The operation of the inkjet printer 100 to which the automatic maintenance-performing apparatus 111 according to an aspect of the present invention is provided will be described in great detail with reference to FIGS. 2 and 4.

When the power switch 112 is turned off and the power plug 110 is connected to the socket of the electric power source, the electric power is supplied only to the control unit 118 through the first power supply 113*a*.

Accordingly, the control unit 118 drives the automatic maintenance executing program 117 to determine whether the first and the second power supplies 113*a* and 113*b* are operational (S1).

At this point, since the power plug 110 is connected to the socket, and the power switch 112 is turned off, the control unit 118 determines that the first power supply 113*a* is in the 'on' state and the second power supply 113*b* is in the 'off' state, and sets the timer 116 to a zero value (S2) and drives the timer 116 to count time (S3).

While the timer 116 counts the time, the control unit 118 determines whether the second power supply 113*b* is operated into the 'on' state by the power switch 112 turned on by user or the relay switch 115*c* of the switching portion 115 turned on by a reserved print command inputted into the control unit 118 from an outside computer, or a reserved print command inputted into the control unit 118 via the control panel connected thereto (S4).

In operation S4, upon determining that the second power supply 113*b* is operational and in the 'on' state, the control unit 118 stops the counting operation of the timer 116 through the automatic maintenance executing program 117, and performs operation S9, which will be described below.

Further, upon determining that there is no change to the operation of the second power supply 113*b* in operation S4, the control unit 118 continues the counting operation of the timer 116 and determines whether the time counted by the timer 116 coincides with a predetermined time, for example, a value of one month (S5).

In operation S5, when the counted time coincides with the value of one month, the control unit 118 turns on the relay switch 115*c* of the switching portion 115 to supply the electric power to the second power supply 113*b* (S6), and drives the maintenance driving motor of the maintenance unit 120 and the switching elements of the print heads 119 to perform the maintenance operation of cleaning the surfaces of the ink ejection nozzles of the print heads 119 (S7).

The maintenance operation is carried out by driving the maintenance driving motor of the maintenance unit 120 in one direction, for example in a clockwise direction by the control unit 118 to uncap and wipe the surfaces of the ink ejection nozzles of the print heads 119 through the capping member transporting part to convert a rotation force of the maintenance driving motor to a vertical force and transmit the converted force to the capping member and the wiping member transporting part to convert the rotation force of the maintenance driving motor to a horizontal force and transmitting the converted force to the wiping member; controlling the switching elements connected to the heaters of the print heads 119 by the control unit 118 to spit ink through the ink ejection nozzles of the print heads 119; and driving the maintenance driving motor of the maintenance unit 120 in the other direction, that is, in an anti-clockwise direction, by the control unit 118 to wipe and cap the surfaces of the ink ejection nozzles of the print heads 119 through the wiping member transporting part and the capping member transporting part.

Upon performing the maintenance operation, the control unit 118 outputs a control signal to the transistor 115*a* to turn off the relay switch 115*c* of the switching portion 115. As a result, the electric power is not supplied to the second power supply 113*b* (S8).

After that, the control unit 118 determines whether the second power supply 113*b* is operated in the 'on' state by the power switch 112 turned on by user or the relay switch 115*c* of the switching portion 115 turned on by another reserved print command inputted into the control unit 118 from the outside computer, or another reserved printing command inputted into the control unit 118 through the control panel connected thereto (S9).

After completion of operation S9, when there is no change to the operation of the second power supply 113*b*, the control unit 118 periodically repeats the operation S1 through S8 at the predetermined time, that is, one month.

However, during operation S9, upon determining that the second power supply 113*b* is in operation and in the 'on' state, the control unit 118 sets the timer 116 to a zero value (S10), and then drives the timer 116 to count a time (S11).

While the timer 116 counts the time, the control unit 118 determines whether a print command or a maintenance command, such as a head cleaning command, is inputted from the printer 100 or the outside computer (S12).

According to operation S12, when the print command or the maintenance command is determined to have been inputted, the control unit 118 drives the carrier driving motor of the driving unit 122 and the switching elements of the print heads 119 to perform the printing operation in a known manner, or drives the maintenance driving motor of the maintenance unit 120 and the switching elements of the print heads 119 to perform the maintenance operation of cleaning the surface of the ink ejection nozzles of the print heads 119 similar to operation S7, according to corresponding command (S13), and then repeats the operations after operation S1.

At operation S12, when the print command or the maintenance command is decoded as not inputted, the control unit 118 determines whether there is any change to the operation of the second power supply 113*b*, for example, whether the second power supply 113*b* is in the 'off' state (S14).

As a result of the decision of operation S14, when the second power supply 113*b* is determined to be and in the 'off' state, the control unit 118 repeats the operations after operation S2 as described above, and when there is no change to the operation of the second power supply 113*b*, the control unit 118 continues the counting operation of the timer 116 and determines whether the time counted by the timer 116 coincides with the predetermined time, that is, the value of one month (S15).

At the operation S15, when the counted time coincides with the value of one month, the control unit 118 drives the maintenance driving motor of the maintenance unit 120 and the switching elements of the print head 119 to perform the maintenance operation of cleaning the surfaces of the ink ejection nozzles of the print heads 119 in a similar manner to that of operation S7 (S16), and after the maintenance operation is completed, repeats the operations after operation S1.

As is apparent from the foregoing description, it can be appreciated that the automatic maintenance-performing apparatus and method thereof of the image forming device according to an aspect of the present invention can prevent the ink ejection nozzles of the print heads from being dried and choked, and thereby prevent the deterioration of the performance of the print heads when the image forming device is on standby or has not been used for a long period of time, by automatically performing periodic maintenance operations at the predetermined time.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An automatic maintenance-performing method of an image forming device having a maintenance unit to perform a maintenance operation to ink ejection nozzles to jet ink of print heads, and a control unit to control the maintenance operation having a timer; comprising:

automatically performing a periodic maintenance operation of wiping surfaces of the ink ejection nozzles of the print heads at a predetermined time when a power plug of the image forming device is connected to an electric power source and a power switch of the image forming device is turned off over a period of time.

2. An automatic maintenance-performing method of an image forming device having a maintenance unit to perform a maintenance operation to ink ejection nozzles to jet ink of print heads, and a control unit to control the maintenance operation having a timer; comprising:

automatically performing a periodic maintenance operation at a predetermined time when a power plug of the image forming device is connected to an electric power source and a power switch of the image forming device is turned off over a period of time;

wherein the automatically performing the periodic maintenance operation comprises:

determining whether a first and a second power supply are in operation, the first power supply being connected to a power plug to supply electric power to the control unit, and the second power supply being connected to the power plug through a power switch to supply the electric power to at least the maintenance unit; and periodically operating at least one of the print heads and the maintenance unit at predetermined times when the first power supply is in an 'on' state and the second power supply is in an 'off' state.

3. The automatic maintenance-performing method according to claim 2, wherein the determining of whether the first and the second power supply are in operation comprises:

determining the first power supply is in operation and in the 'on' state when the power plug is connected to a socket of an electric power source;

determining the second power supply is in operation and in an 'on' state by one of when the power switch is turned on and when the control unit generates a control signal by one of a command from an automatic maintenance executing program to control the control unit to perform the maintenance operation when a time counted by the timer coincides with the predetermined period, a command inputted through a control panel connected to the control unit, and a command from an outside computer.

4. The automatic maintenance-performing method according to claim 2, wherein the operating of at least one of the print heads and the maintenance unit comprises:

beginning counting time via a timer of the control unit;

determining whether the time counted by the timer coincides with the predetermined time;

supplying the electric power to the second power supply when the counted time coincides with the predetermined period;

cleaning the print heads by operating the at least one of print heads and the maintenance unit after the electric power is supplied to the second power supply; and disconnecting the electric power from the second power supply after the at least one of the print heads and the maintenance unit has been operated.

5. The automatic maintenance-performing method according to claim 4, further comprising:

turning on and turning off a switching portion connected to the power plug and the first power supply in response to a control signal of the control unit to supply and disconnect the electric power to and from the second power supply, respectively.

6. The automatic maintenance-performing method according to claim 2, wherein the determining of whether the first and the second power supplies are in operation comprises:

determining whether at least one of a print command from an outside computer and a print head cleaning command is input when both the first and second power supply are determined to be in operation and in the 'on' state; and operating the at least one of the print heads and the maintenance unit to perform the maintenance operation at the predetermined time when the at least one of the print command from the outside computer and the print head cleaning command is determined to be not inputted, and at the predetermined time from a point of time when one of a printing operation and a print head cleaning operation is performed according to corresponding command, when the at least one of the print command from the outside computer and the print head cleaning command is determined as having been inputted.

7. The automatic maintenance-performing method according to claim 6, wherein operating of the at least one of the print heads and the maintenance unit upon determining whether at least one of the print command from the outside computer and the print head cleaning command is inputted comprises:

beginning counting time via the timer of the control unit;

determining whether the time counted by the timer coincides with the predetermined period; and cleaning the print heads by operating the at least one of print heads and the maintenance unit when the counted time coincides with the predetermined period.

8. An automatic maintenance-performing apparatus of an image forming device, comprising:

a maintenance unit to perform a maintenance operation to ink ejection nozzles to jet ink of print heads;

a control unit to control the maintenance operation; and an automatic maintenance executing unit to automatically perform the maintenance operation of wiping surfaces of the ink ejection nozzles of the print heads at a predetermined time when a power plug of the image forming device is connected to an electric power source and a power switch of the image forming device is turned off for a period of time.

9. The automatic maintenance-performing apparatus according to claim 8, wherein the control unit controls the operation of switching elements of the print heads to jet ink through ink ejection nozzles of the print heads.

10. An automatic maintenance-performing apparatus of an image forming device, comprising:

a maintenance unit to perform a maintenance operation to ink ejection nozzles to jet ink of print heads;

a control unit to control the maintenance operation; and an automatic maintenance executing unit to automatically perform the maintenance operation at a predetermined time when a power plug of the image forming device is connected to an electric power source and a power switch of the image forming device is turned off for a period of time;

wherein the automatic maintenance executing unit comprises:

a power supplying part having a first power supply to supply an electric power to the control unit and connected to a power plug, and a second power supply to supply the electric power to at least the maintenance unit and connected to the power plug through a power switch; and a maintenance executing part to count a time and supply the electric power to the second power supply to perform the maintenance operation depending on whether the second power supply is in an 'on' state or an 'off' state when the counted time passes a predetermined time period.

11. The automatic maintenance-performing apparatus according to claim 10, wherein the maintenance executing part comprises:

a switching portion connected to the power plug and the first power supply;

a timer built in the control unit to count time; and an automatic maintenance executing program provided to the control unit and operating the switching portion to supply the electric power to the second power supply and thereby perform the maintenance operation, depending on whether the second power supply is in the 'on' state or the 'off' state when the counted time coincides with the predetermined time period.

12. The automatic maintenance-performing apparatus according to claim 11, wherein the switching portion comprises:

a transistor to operate in response to the control signal of the control unit;

an inductance to receive the electric power from the power plug in accordance with the operation of the transistor; and a relay switch switchable by a magnetic induction phenomenon generating when the inductance receives the electric power from the power plug.

13. The automatic maintenance-performing apparatus according to claim 12, wherein the switching portion connects or disconnects the second power supply to or from the power plug connected to the socket of the electric power source in accordance with a reserved print command inputted into the control unit from an outside computer or a reserved print command inputted into the control unit, and a maintenance command of the control unit issued by the automatic maintenance executing program.

14. The automatic maintenance-performing apparatus according to claim 11, wherein the switching portion is provided between the first power supply and the second power supply.

15. The automatic maintenance-performing apparatus according to claim 10, wherein the maintenance unit comprises:

a capping member having two caps to seal surfaces of the ink ejection nozzles of the print heads mounted to a carrier and movable between a printing position and a maintenance position;

a wiping member having two wipers to wipe the surfaces of the ink ejection nozzles of the print heads;

a power transmission part to receive a rotation force from a maintenance driving motor provided separately from a carrier driving motor to drive the carrier;

a capping member transporting part to convert a rotation force of the power transmission part to a vertical force and transmit the converted force to the capping member; and a wiping member transporting part to convert a rotation force of the power transmission part to a horizontal force and transmit the converted force to the wiping member, having a used ink storing portion to store used ink jetted from the ink ejection nozzles of the print heads in a spitting operation.

16. The automatic maintenance-performing apparatus according to claim 15, wherein the maintenance driving motor connected to the second power supply of the power supply part is controlled by the control unit to operate the maintenance unit to perform the maintenance operation of uncapping, wiping, and capping the surfaces of the ink ejection nozzles of the print heads.

17. The automatic maintenance-performing apparatus according to claim 10, wherein the first power supply of the power supplying part converts an electric power supplied from the power plug to a voltage required by the control unit, and the second power supply converts the electric power supplied from the power plug to a voltage required by the maintenance unit.

18. The automatic maintenance-performing apparatus according to claim 17 wherein the electric power is supplied only to the control unit through the first power supply when the power switch is turned off.

19. A method of performing an automatic maintenance of an image forming device, comprising:

periodically determining whether a first and a second power supply are on;

counting time via a timer upon determination that the first and/or the second power supply are off;

determining whether the counted time coincides with a predetermined time;

supplying electric power to the first or second power supply; and performing cleaning operation of ink ejection nozzles of at least one print head.

20. The method according to claim 19, further comprising:

re-determining whether the first or the second power supply is on during the start of count via the timer.

21. The method according to claim 20, wherein the timer is reset to zero upon determining that the first or the second power supply are on.

22. An automatic maintenance-performing apparatus of an image forming device, comprising:

a maintenance unit to perform a maintenance operation to ink ejection nozzles to jet ink of print heads;

a control unit to control the maintenance operation;

a power supplying part having a first power supply to supply an electric power to the control unit and connected to a power plug, and a second power supply to supply the electric power to at least the maintenance unit and connected to the power plug through a power switch; and a maintenance executing part comprising a timer to count time, the maintenance executing part counting a time and supplying the electric power to the second power supply to perform the maintenance operation depending on when the power plug is connected to an electric power source and the power switch is turned off, for a predetermined time period.

* * * * *